United States Patent [19]

Henchiri et al.

[11] 4,324,653

[45] Apr. 13, 1982

[54] PROCESS FOR THE TREATMENT OF PHOSPHATE ORES WITH SILICO-CARBONATE GANGUE

[75] Inventors: Amar Henchiri; Jean-Luc Cecile; Gérard Baudet; Gilles Barbery, all of Orleans; René Bloise, Saint Denis en Val, all of France

[73] Assignee: Bureau de Recherches Geologiques et Minieres, Paris, France

[21] Appl. No.: 210,757

[22] Filed: Nov. 26, 1980

[30] Foreign Application Priority Data

Dec. 17, 1979 [FR] France ..... 79 30868

[51] Int. Cl.[3] ..... B03D 1/06

[52] U.S. Cl. ..... 209/167; 209/166

[58] Field of Search ..... 209/166, 167

[56] References Cited

U.S. PATENT DOCUMENTS

| | | | |
|---|---|---|---|
| 2,162,494 | 6/1939 | Trotter | 209/166 |
| 3,113,838 | 12/1963 | Perri | 209/166 X |
| 3,462,016 | 8/1969 | Bushell | 209/166 |
| 3,480,143 | 11/1969 | Mitzmager | 209/166 |
| 3,804,243 | 4/1974 | Yang | 209/166 |
| 4,081,363 | 3/1978 | Grayson | 209/166 |

FOREIGN PATENT DOCUMENTS

| | | | |
|---|---|---|---|
| 1175623 | 8/1964 | Fed. Rep. of Germany | 209/166 |

*Primary Examiner*—Robert Halper

*Attorney, Agent, or Firm*—Frost & Jacobs

[57] ABSTRACT

A process for recovery of phosphates in ores with silico-carbonate gangue:

(1) overall flotation of the ore with a collector comprising essentially a phosphoric ester in an amount and under conditions capable of causing the silicate compounds to pass into the flotation residue, and in recovering a float product containing the phosphate and carbonate compounds.

(2) conditioning the float product in an acid medium for a length of time sufficient to cause the flotation of carbonates, while the phosphates constituting the valuable product desired, remain in the residue.

9 Claims, No Drawings

PROCESS FOR THE TREATMENT OF PHOSPHATE ORES WITH SILICO-CARBONATE GANGUE

The invention relates to the field of ore treatment, notably involving a flotation step. It is applicable to phosphate ores with silico-carbonate gangue.

Although the flotation of phosphates with silicate gangue is no longer a problem, the enrichment of sedimentary ores with carbonate gangue is still difficult in the present state of mineralogical techniques.

Processes are already known for the treatment of silico-carbonate gangue ores. The article in the review "Industrie Minérale Minéralurgie," September 1976, page 113, reports flotation trials conducted on Karatau phosphates in the Soviet Union. This is one of the biggest deposits of sedimentary carbonate phosphates in the world. The ore mainly comprises phosphate particles, dolomite, calcite and silica in the form of quartz. The following is a typical chemical composition:

| | |
|---|---|
| $P_2O_5$ | 22–23% |
| MgO | 2.8–3% |
| $CO_2$ | 8–10% |
| insolubles | 16.0–20%. |

Flotation is effected in two steps. The purpose of the first flotation being to remove the carbonates and to leave in the cell, as residue, the phosphates and the silicates. The flotation reagent, or collector, is selected from $C_{10}$–$C_{16}$ synthetic fatty acids used at a rate of 0.3 kg/t; the value is maintained between 4.8 and 5 by means of phosphoric acid. In a second step, the collector is changed, the phosphates are floated with an emulsion of tall oil in kerosene. The medium is then adjusted with sodium hydroxyde to a pH of 7.7 to 8. Furthermore, the silica and silicates are depressed by sodium silicate (at a rate of 0.5 kg/t). The concentrate obtained assays 28% $P_2O_5$, with a recovery rate of 75%. Such a process has two serious drawbacks. The most important residing in the fact that it is necessary to use two different collectors for the two successive flotation steps. Moreover, in the first flotation, the phosphoric acid is a relatively expensive compound.

Another process was described by A. R. RULE et al. in "Report of investigations 7864" of the U.S. Bureau of Mines, with the title "Flotation of carbonate minerals from unaltered phosphate ores of the phosphoria formation," and later in a communication presented by the authors at the seminar on beneficiating of poor mineral phosphates with carbonate gangue at the 11th International Congress on ore preparation, held at Cagliari in April 1975.

If need be, the one skilled in the art can refer to this article and to all the bibliographical references it contains. Briefly the treatment relates to partially altered phosphates of Phosphoria formation, containing carbonates and silicates. The following is a typical dominant composition:

| | |
|---|---|
| $P_2O_5$ | 24% |
| CaO | 40.8% |
| $SiO_2$ | 12.8% |
| MgO | 2.4% |

Anionic flotation of carbonates is first effected with a fatty acid emulsion (15%), pine oil (0.5%) and sodium hydroxyde (0.5%); the collector is therefore a refined fatty acid. The phosphates are depressed with sodium fluosilicate, i.e. that hydrofluorsilicic acid $H_2SiF_6$ is added as reagent. The drawback of this compound is that it is highly polluting for the environment, a fact that seriously offsets the advantage of its low cost. The silicates and phosphates remain in the bottom of the flotation cell and constitute the final concentrate.

This concentrate contains 29.1% $P_2O_5$ with 57.6% recovery.

The yield of this process is, therefore, mediocre.

U.S. Pat. No. 4,144,969 may also be mentioned as a reference illustrating the prior art.

The process described in this U.S. patent is applied to the purification of phosphate preconcentrates obtained from one or two flotation steps during which the silica has been removed. These preconcentrates contain small proportions of residual carbonates mostly in the dolomite form. The process consists in conditioning the preconcentrate by a depresser of the carbonate in the form of a compound containing the anion $F^-$, by successive additions of a cationic collector for apatite, associated with a liquid hydrocarbon, followed by flotation of the apatite. This process therefore involves two or three flotation steps: direct anionic flotation of the phosphate followed, if necessary, by a cationic flotation to remove the silica and obtain a phosphate preconcentrate, which is subjected to cationic flotation in order to remove the dolomite. In another connection, the process of U.S. Pat. No. 4,144,969 essentially applies to ores with low carbonate contents, for example, to phosphate preconcentrates assaying from 1 to 3% MgO. The disclosed process is, therefore, long, complicated and limited to its applications to the purification of phosphate preconcentrates.

U.S. Pat. No. 3,462,017 claims a process for the separation of silicates-phosphates-carbonates by flotation, comprising three steps:

- overall flotation of carbonates and phosphate by fatty acids, the silica and silicates remaining in the bottom of the cell and being removed as sterile;
- conditioning the overall phosphate+carbonates concentrate by phosphoric acid or an alkaline phosphate (Na, K or $NH_4$ phosphate) resulting in the depression of phosphate particles, for a pH of 5.5. to 6.5;
- flotation of carbonates, leaving the phosphate concentrate at the bottom of the cell.

The collectors, i.e., the fatty acids used for the treatment of phosphates in the first step of this process do not permit selective separations. Furthermore, the phosphoric acid and the alkaline phosphates used as phosphate depressors are costly reagents.

French Pat. No. 73 38 413 (Publication No. 2,248,878) related to a process for the treatment of phosphate with carbonate gangue, but the type of ore concerned does not contain silica. This is also a multi-step process in which separation of the phosphates and carbonates is effected by a reverse flotation treatment in which a flotation collector of carbonates and compounds is used to depress the phosphate particles.

The process described in FR Pat. No. 73 38413 (published under No. 2,248,878) relates to a process for treatment of phosphate having carbonate-gangue, but the concerned ore type does not contain silica. It is a multi-step process in which the separation of phosphates and carbonates is effected by an inversed flotation treatment, in which are used a collector for carbonate flotation and compounds which depress the phosphate particles.

The process disclosed in FR Pat. No. 73 38 413 consists in:

conditioning by one or more simple or complex metal salts, in combination with a complexing agent in a weight ratio of 1:1 to 1:6. These conditioning agents may be, for example, an aluminium sulphate associated with sodium-potassium tartrate, at a pH in the order of 6, they induce depression of the phosphate, flotation of the carbonates by an anionic collector (fatty acids or salts of fatty acids) or a cationic collector (amines).

It is seen, therefore, that this process involves direct flotation of carbonates, and does not disclose the separation of silicates. Moreover, the process is limited to ores with carbonate gangue. Furthermore, the reagents used to depress the phosphates are costly, the addition to the ore pulp being difficult to control (metal salts in combination with a complexing agent in a given preparation). The carbonate collector reagents are the usual surfactants used in flotation, and therefore lack selectivity for carbonate-phosphate separation. Selectivity for said separation is obtained by the addition of a complex depressing formulation.

German Pat. No. 1,175,623 describes a process for the flotation of apatite by phosphoric esters in a range of pH 7 to 8, the iron oxides may be then separated from the gangue material by flotation with phosphoric esters with a pH in the range of 3 to 4.

The examples of separation cited in this patent relate to fine fractions of American phosphate ores which are ores with clayey-siliceous gangue; sodium silicate is used to disperse and to depress this silicate gangue. Thus, in said German Pat. No. 1,175,623, the concentration of phosphate is obtained by flotation of apatite, in the absence of carbonated ores. Sodium silicate is used as dispersant and depressor for the silicate gangue.

Other relevant bibliographical references illustrating the prior art are mentioned in annual patent anthology of Olivier S. North (Mineral Exploration, Mining and processing patents) which cites, on page 31 of the 1974 edition, CA Pat. No. 939,836 and, on page 22 of the 1977 edition U.S. Pat. No. 4,059,509.

The above short remainder of the prior art shows that, up to now, a selective collector floating one of the minerals and leaving the other in the residue has not yet been discovered for the treatment of phosphate ores with silico-carbonate gangue. Selectivity is lined with the nature and the conditions of use of the depressor. The profitability of the process is therefore closely connected with the cost of the depressor.

The object of the invention is a process which is both efficient and economic for the treatment of phosphate ores with silico-carbonate gangue.

The process of the invention is characterized by the combination of a flotation step and a conditioning step.

In its general form, the object of the invention is a process for the treatment of flotation of phosphate ores with a silicocarbonate gangue, comprising the steps of:

(1) overall flotation of the ore with a collector essentially comprising a phosphoric ester in an amount and under conditions capable of causing the silicate compounds to be transferred into the flotation residue, and in recovering a floating product containing the phosphate and carbonate compounds, (2) conditioning the floating product in an acid medium for a length of time sufficient to effect flotation of carbonates while the phosphates, which is the valuable product sought, remain in the residue.

Step (1) of the process of the invention consists in an overall flotation in which the collector is a phosphoric ester. For the requirements of the invention, any phosphoric ester or mixture of said esters may be used. It was observed that, owing to the excellent foaming properties of phosphoric esters, it was unnecessary to add an emulsifier to the ore during flotation.

The concentration of phosphoric ester collector is advantageously in the range of 400 to 500 g/t. Such a range of concentration makes it possible for the process to be economically very attractive as, even though phosphoric esters are more expensive than the fatty acids often used as flotation collectors.

Another advantage of the invention is that the flotation step can be carried out at the natural pH of the pulp, which is approximately 7.8. It is therefore not necessary to add a pH-regulating product.

For the practical needs of the invention, phosphoric esters consisting essentially of alkyl phosphates, such as $C_8$–$C_{20}$ alkylphosphates were used advantageously. Such products are available on the market in the form of mixtures of mono-esters and di-esters. Generally speaking, the mixture contains considerably larger amounts of mono-esters.

Other phosphoric esters which have been shown to be advantageous as flotation collectors are organic phosphates with a chain comprising alkylene oxide units, preferably ethylene oxide. These compounds are known and can be prepared by condensation of alkylene oxide on straight chain phosphates. The number of alkylene oxide units, and particularly of ethylene oxide, present in the chain of the phosphoric ester has an effect upon the solubilization properties of the ester. Good results were obtained with phosphates comprising from 4 to 9 moles of ethylene oxide.

Phosphoric ester products particularly suitable for the requirements of the invention are notably put on the market under the trade name F 1415 by Hoechst (GFR) and BEYCOSTAT type LP9A or LP4A by the French firm Gerland.

The second step of the invention process consists in conditioning the float. Such a step is advantageously effected on a thick pulp, i.e. one with a relatively high solids content. The float is, therefore, conditioned at a dry matter content in the range of 30 to 60% for example at between 45 and 50%, to obtain the best results.

It was also found that if the step is effected at the natural pH of the pulp, carbonate-phosphate separation could take place but that yields were insufficient. Adjustment of the pH of the medium to an acid value encourages the depression of phosphate elements. This is why it is preferred to operate in an acid medium at a pH notably lying between 5 and 6. Any easily available acid will be used to adjust the acid pH. Preference will be given to mineral acids and more particularly to sulphuric acid which is the least expensive. It would be equally well possible to use hydrochloric acid or nitric acid. The organic acids are less advantageous owing to their cost being more expensive.

The second step of the process of the invention is a true conditioning step insofar as no collector is added to the reaction medium. The time of conditioning acts as depressor in order to permit mechanical desorption. Duration of conditioning should therefore be long enough to ensure the separation of carbonates and phosphates. In practice, it has been found that times in the order of 5 minutes are satisfactory. The conditioning vat will therefore be of a size enabling the pulp to be held for a suitable time. This is a decisive parameter to obtain good separation results. It goes without saying that mechanical stirring means are used in the conditioning vat.

The process of the invention makes it possible to treat any kind of phosphate ore with silico-carbonate gangue. It is notably possible to successfully treat ores containing phosphates, silicates and several types of carbonates such as $CO_3Ca$ and $CO_3Mg$.

The process of the invention combines a single flotation step and a conditioning. The latter must be effected for a sufficiently long period of time. The best results were obtained with durations in the range of 3 to 15 minutes, for example between 5 and 10 minutes.

The recovery yield obtained with the process of the invention is high. For example, with a sedimentary phosphate ore with silico-carbonate gangue assaying: $P_2O_5$=19%, $CO_2$=13.40%, MgO=1.60%, $SiO_2$=14.25%, a concentrate assaying 28.10% of $P_2O_5$ with a recovery rate of about 76% was obtained.

The invention will now be illustrated, while in no way being limited, by the following examples.

EXAMPLE 1

350 g of a silico-carbonate phosphate ore assaying 20.25% $P_2O_5$ from the AYATA (Tunisia) deposit was treated according to the process of the invention.

The following two successive steps were effected:

(a) Conditioning of the pulp (mixture of ore and water) at a concentration of 33% solids, at the natural pH of the pulp (7.60–7.80) and in the presence of a collector consisting of 400 grams of phosphoric ester per ton of ore, said ester being product F 1415 put on the market by Hoechst, which is phosphoric ester containing a predominant proportion of monoester. Duration of conditioning: 3 minutes, (b) Dilution of the pulp to 25% solids and overall flotation of the carbonate+phosphate mass. Under these operating conditions, the silicate gangue is not taken up by the foams and remains as a flotation residue ($R_1$). Flotation time was 2.5 minutes, (c) The foams consisting of carbonates and phosphates are thickened by a rapid decanting step to obtain a concentration of 45% solids; there are then subjected to conditioning for 5 minutes in an acid medium obtained by the addition of dilute sulphuric acid (5 kg/t), (d) The pulp is readjusted to a solids content of 25% and is subjected to a final concentration step by simple flotation of carbonates ($R_2$) without the addition of a reagent. The phosphates remain in the cell. An additional flotation step (reject $R_3$) starting with a further addition of 100 g/ton of phosphoric ester as defined hereinbove makes it possible to purify still further the final phosphate concentrate.

The analytic results are given in table I below:

TABLE I

| Product | Weight in % | % $P_2O_5$ | Recovery % $P_2O_5$ |
|---|---|---|---|
| Phosphate concentrate | 54.3 | 28.10 | 75.3 |
| Reject: $R_3$ | 3.0 | 13.20 | 2.0 |
| Reject: $R_2$ | 22.7 | 10.70 | 12.0 |
| Reject: $R_1$ | 20.0 | 10.85 | 10.7 |
| Feed | 100.0 | 20.25 | 100.0 |

This example shows that the invention makes it possible, starting from a silico-carbonate phosphate ore assaying 20.25% $P_2O_5$, to separate a phosphate concentrate assaying 28.10% $P_2O_5$ with a recovery of 75.3% of the total phosphate contained in the feed.

EXAMPLE 2

The same general procedure was used as in example 1, except for varying the duration of conditioning step (c) of the first carbonate-phosphate foams before their further treatment; the other parameters remaining unchanged. Time of conditioning was lengthened from 5 to 10 minutes.

The analytic results obtained are given in table II below.

TABLE II

| Product | Weight in % | % $P_2O_5$ | recovery in % $P_2O_5$ |
|---|---|---|---|
| Concentrate | 62.0 | 27.10 | 83.3 |
| Reject 3 | 1.3 | 4.80 | 0.3 |
| Reject 2 | 16.0 | 7.0 | 5.5 |
| Reject 1 | 20.7 | 10.6 | 10.9 |
| Feed | 100.0 | 20.2 | 100.0 |

The results in table II show that, when the time of conditioning is changed from 5 to 10 minutes, a slightly less rich concentrate is obtained but that recovery is better.

EXAMPLE 3

The same general operating procedure was used as in example 1, but the retreatment of foams in step (c) was effected at natural pH.

Conditioning lasted for 5 minutes.

The analytical results are shown in table III.

The results of table III demonstrate the effect of pH on the results obtained in conditioning step (c). It was also found that the acid pH played a part as great as the duration of conditioning in obtaining satisfactory separation of phosphates and carbonates. In particular, it will be noted the prohibitive carrying off of phosphates in reject $R_3$, when operating at the natural pH of the medium, without the addition of acid.

TABLE III

| Product | Weight in % | % $P_2O_5$ | Recovery in % $P_2O_5$ |
|---|---|---|---|
| Concentrated | 29.0 | 25.2 | 36.4 |
| Reject 3 | 29.0 | 26.3 | 38.3 |
| Reject 2 | 24.1 | 14.9 | 18.0 |
| Reject 1 | 17.9 | 8.10 | 7.3 |
| Feed | 100.0 | 19.92 | 100.0 |

EXAMPLE 4

The same procedure was used as in examples 1 to 3 but, instead of the product F1415, each of the compounds BEYCOSTAT LP4A and LP9A supplied by the firm Gerland were used as phosphoric ester flotation reagent. Both these compounds are anionic type phosphoric esters.

Similar results were obtained for the separation of the phosphate concentrate and the recovery of the phosphate contained in the starting ore.

What we claim is:

1. A process for the treatment by flotation of phosphate ores with silico-carbonate gangue, comprising the steps of:

(1) overall flotation of the ore with a collector comprising essentially phosphoric ester in an amount and under conditions capable of causing the silicate compounds to pass into the flotation residue, said flotation step being effected at the natural pH of the ore pulp, and recovering a float product containing the phosphate and carbonate compounds, (2) conditioning the float product in an acid medium free of phosphoric acid for a time sufficient to effect the flotation of carbonates, while the phosphates, which are the valuable product desired, remain in the residue.

2. Process according to claim 1, wherein the concentration of the phosphoric ester collector in step (1) is in the range of about 400 to 500 g per ton of ore.

3. Process according to claim 1, wherein phosphoric ester is selected from the group of alkyl phosphates and linear alkyl phosphates having alkylene oxide units.

4. Process of claim 3, wherein the alkyl-phosphates are $C_8$–$C_{20}$ alkyl-phosphates.

5. Process of claim 3, wherein the linear alkyl-phosphates with alkylene oxide units are alkyl-phosphates with ethylene oxide residues.

6. Process of claim 5, wherein alkyl-phosphates have 4 to 9 ethylene oxide.

7. Process according to claim 1 wherein, in step (2), the float product is conditioned to a solids content in the range of between about 30 and 60%.

8. Process according to claim 1, wherein in step (2) the pH is adjusted to about 5 to 6.

9. Process according to claim 1, wherein the conditioning is effected for a period of time in the range of about 3 to 15 minutes.

* * * * *